US008831463B2

(12) United States Patent
Kondo et al.

(10) Patent No.: US 8,831,463 B2
(45) Date of Patent: Sep. 9, 2014

(54) IMAGE FORMING APPARATUS

(75) Inventors: Kazuyoshi Kondo, Tokyo (JP); Haruo Hashimoto, Osaka (JP); Genta Hagiwara, Osaka (JP); Masafumi Takahira, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/468,382

(22) Filed: May 10, 2012

(65) Prior Publication Data

US 2012/0315061 A1 Dec. 13, 2012

(30) Foreign Application Priority Data

Jun. 8, 2011 (JP) ..... 2011-128157

(51) Int. Cl.
*G03G 21/20* (2006.01)

(52) U.S. Cl.
USPC ..... 399/91; 399/92

(58) Field of Classification Search
USPC ..... 399/92, 91
See application file for complete search history.

(56) References Cited

U.S. PATENT DOCUMENTS

| | | | | |
|---|---|---|---|---|
| 5,325,158 | A * | 6/1994 | Guelfo et al. | 399/92 |
| 7,941,069 | B2 | 5/2011 | Idehara et al. | |
| 2007/0065201 | A1 | 3/2007 | Fujiwara et al. | |
| 2011/0058847 | A1 | 3/2011 | Furuichi et al. | |

FOREIGN PATENT DOCUMENTS

| | | |
|---|---|---|
| JP | 2003-337522 | 11/2003 |
| JP | 2007-298629 | 11/2007 |
| JP | 2008-164902 | 7/2008 |
| JP | 4113643 B2 | 7/2008 |
| JP | 2012-14102 | 1/2012 |
| JP | 2012-78762 | 4/2012 |

OTHER PUBLICATIONS

Combined Office Action and Search Report issued Nov. 4, 2013 in Chinese Application No. 201210184128.9.

* cited by examiner

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

An image forming apparatus includes an outer cover in which an air intake and an exhaust outlet are formed, an image forming unit, a fixing device to fix an image on a recording medium and including a fixing casing in which a sheet inlet and a first exhaust opening are formed, and a thermal shield disposed above the sheet inlet of the fixing device and between the fixing device and a component adjacent to the fixing device, an air channel to guide air sucked in through the air intake to the exhaust outlet, defined by the thermal shield as well as the fixing casing. The first exhaust opening formed in the fixing casing communicates with the air channel formed by the thermal shield and the fixing casing to merge the hot air discharged from the fixing device into the air flowing in the air channel.

17 Claims, 5 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2011-128157, filed on Jun. 8, 2011, in the Japan Patent Office, the entire disclosure of which is hereby incorporated by reference herein.

FIELD OF THE INVENTION

The present invention generally relates to an image forming apparatus, such as a copier, a printer, a plotter, or a multifunction machine including at least two of these functions.

BACKGROUND OF THE INVENTION

Image forming apparatuses, such as printers, facsimiles, copiers, and multifunction apparatuses, generally include a fixing device to fix toner images formed on sheets of recording media such as paper or overhead projector (OHP) films. Fixing devices typically include a heat source, a fixing member heated by the heat source, and a member disposed facing (or pressing against) the fixing member, forming a fixing nip therebetween. Such fixing devices fix the toner image on the sheet with heat and pressure while the sheet passes through the fixing nip.

If heat generated by the fixing device raises the temperature inside the image forming apparatus beyond a certain point, toner contained in a toner container inside the apparatus might be fused and coagulated, or components adjacent to the fixing device are affected adversely. For example, forced-exhaust means such as fans may be used to discharge hot air heated by the fixing device outside the apparatus.

However, it is possible that such forced-exhaust means generate noise, thus degrading ambient environmental conditions. Additionally, providing forced-exhaust means increases the size of the apparatus.

In view of the foregoing, natural convection may be employed in exhaust structures to discharge hot air released from the fixing device outside the apparatus without using any forced-exhaust means.

For example, JP-2007-298629-A proposes an exhaust structure designed to prevent hot air, heated by the fixing device and sheets transported through a post-fixing path immediately downstream from the fixing device, from flowing to the image forming unit. The structure includes a thermal shield that separates the fixing device and the post-fixing path from components susceptible to thermal effects, and an end of the thermal shield is connected to an exterior of the apparatus. Hot air is exhausted through an air channel formed between the thermal shield and the fixing device, and the air channel includes a horizontal portion. Although making a part of the air channel horizontal can increase design flexibility, velocity of the airflow decreases in the horizontal portion in natural convection methods.

BRIEF SUMMARY OF THE INVENTION

In view of the foregoing, one embodiment of the present invention provides an image forming apparatus that includes an outer cover in which an air intake and an exhaust outlet are formed, an image forming unit to form an image on a recording medium, a fixing device to fix the image on the recording medium, and a thermal shield disposed above the fixing device. The fixing device includes a fixing casing, and a sheet inlet through which the recording medium enters the fixing device and a first exhaust opening to discharge hot air from the fixing device are formed in the fixing casing. The thermal shield is positioned above the sheet inlet of the fixing device and between the fixing device and a component adjacent to the fixing device. The thermal shield and the fixing casing together form an air channel to guide air sucked in through the air intake to the exhaust outlet. The first exhaust opening formed in the fixing casing communicates with the air channel formed by the thermal shield and the fixing casing, and the hot air discharged from the fixing device is merged into the air flowing in the air channel.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
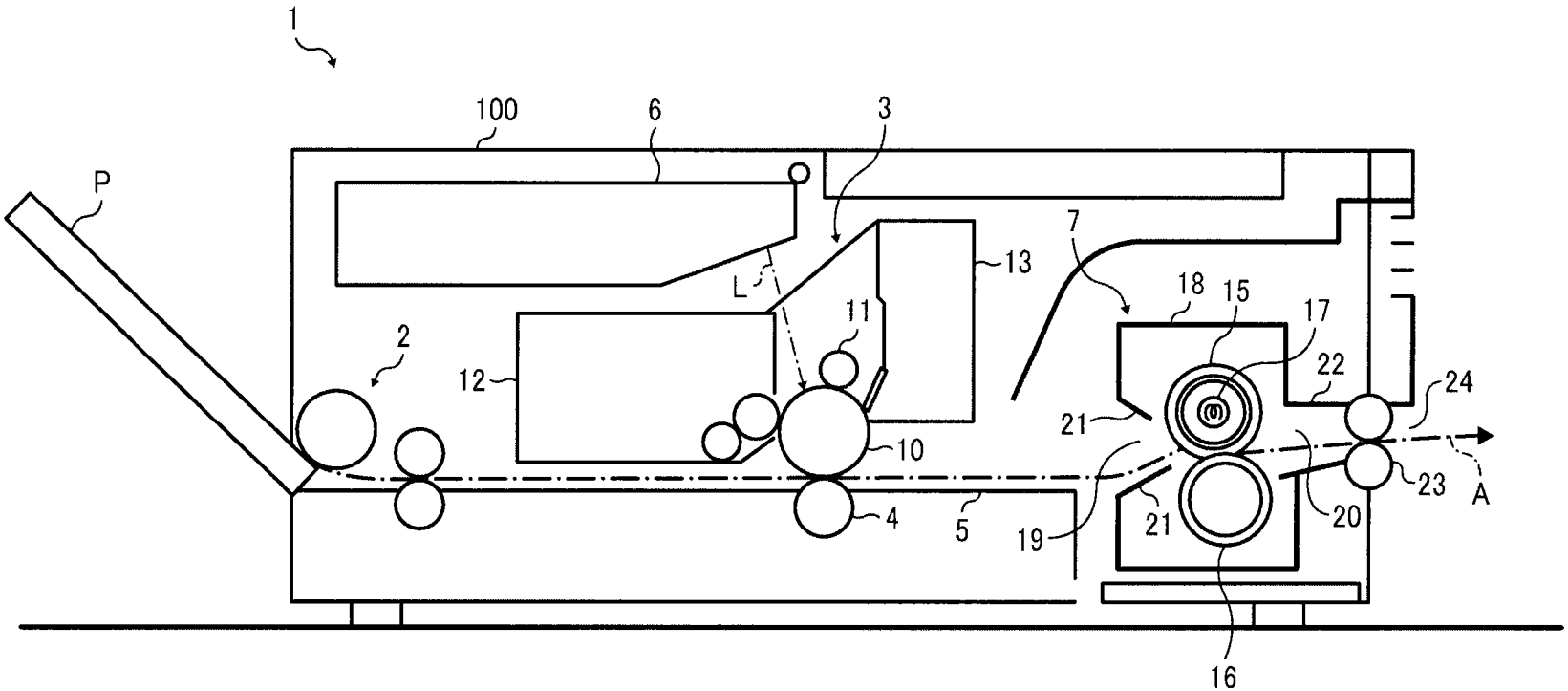
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic cross-sectional view of an image forming apparatus 1 according to the present embodiment. For example, the image forming apparatus 1 can be a laser printer.

Referring to FIG. 1, the image forming apparatus 1 includes a printer body 100, a sheet feeding device 2 disposed in an end portion of the printer body 100 (on the left in FIG. 1) to feed sheets P of recording media to the printer body 100, and a process unit 3 (image forming unit) to form toner images, disposed in a center portion of the printer body 100.

The image forming apparatus 1 further includes a transfer roller 4 and a conveyance guide 5 both disposed beneath the process unit 3. The transfer roller 4 serves as a transfer device to transfer toner images to the sheets P. The conveyance guide 5 supports the sheet P and guides the sheet P in a predetermined direction.

Above the process unit 3, an exposure unit 6 is provided to direct a laser beam L to the process unit 3, thereby forming an electrostatic latent image. In the other end portion (on the right in FIG. 1) of the image forming apparatus 1, a fixing device 7 to fix the toner image on the sheet P is provided. The image forming apparatus 1 shown in FIG. 1 executes image formation while the sheet P fed by the sheet feeding device 2 is conveyed through a conveyance path extending in the direction indicated by broken arrow A (hereinafter "sheet conveyance path A") shown in FIG. 1.

In the process unit 3, a charging device 11, a development device 12, a cleaning device 13, and a discharger are provided around a photoreceptor drum 10 serving as an image bearer. These components are housed in a common unit casing, thus together forming a modular unit. The process unit 3 is replaceable when its operational life has expired.

The conveyance guide 5 guides the sheet P conveyed horizontally and also holds components related to sheet conveyance, namely, the sheet feeding device 2 and the transfer roller 4.

The fixing device 7 includes a fixing roller 15, a pressure roller 16 serving as an opposed member disposed facing the fixing roller 15, and a heater 17, serving as a heat source, disposed inside the fixing roller 15. The pressure roller 16 is pressed against the fixing roller 15, thus forming a fixing nip therebetween.

The fixing roller 15 and the pressure roller 16 are disposed inside a fixing cover 18, which is a casing of the fixing device 7. An sheet inlet 19 and an outlet 20 through which the sheet P enters and exits from the fixing device 7 are formed in the fixing cover 18.

The sheet inlet 19 is provided with a pair of entry guides 21 (i.e., upper and lower entry guides 21) to guide the sheet P to the fixing nip between the fixing roller 15 and the pressure roller 16. The entry guides 21 have fluorine-coated surfaces to reduce resistance against sheet conveyance and facilitate removal of toner therefrom even if unfixed toner adheres to the entry guides 21.

The outlet 20 is provided with a pair of discharge guides 22 (i.e., upper and lower discharge guides 22) and a pair of discharge rollers 23. The discharge guides 22 are designed to guide the sheet P discharged outside the printer body 100.

In the present embodiment, the fixing roller 15 includes a pipe-like metal core and a release layer lying over the metal core. For example, tetrafluoroethylene perfluoroalkylvinylether copolymer (PFA) may be used for the release layer. The pressure roller 16 can be an elastic roller including a metal core, a silicone rubber layer, and a release layer from the inside. For example, PFA may be used for the release layer of the pressure roller 16 similarly. The fixing roller 15 and the pressure roller 16 are pressed against each other with a predetermined pressure by a bias member, thereby forming the fixing nip of, for example, about 4 mm in the direction indicated by arrow A in which the sheet P is conveyed (hereinafter "sheet conveyance direction").

Additionally, a temperature detector such as a thermistor is provided to contact a surface of the fixing roller 15. According to the temperature detected by the temperature detector, heat generation by the heater 17 is controlled so that the surface temperature of the fixing roller 15 is kept within a range of from about 155° C. to 165° C.

It is to be noted that the configuration of the fixing device 7 is not limited to the description above. For example, at least one of the fixing member and the opposed member may be an endless belt or film pressed against the other using a roller or a pad. Further, the fixing member and the opposed member do not necessarily press against each other but may be simply in contact with each other.

Next, image forming operation is described below with reference to FIG. 1.

The image forming apparatus 1 further includes a drive transmission mechanism provided coaxially with the photoreceptor drum 10, and the photoreceptor drum 10 rotates counterclockwise in FIG. 1, driven by a drive device provided to the printer body 100. The charging device 11 can be, for example, a charging roller that rotates as the photoreceptor drum 10 rotates. Receiving voltage from a high-pressure power source, the charging device 11 charges a surface of the photoreceptor drum 10 uniformly.

Subsequently, the exposure unit 6 provided above the process unit 3 in FIG. 1 scans the surface of the photoreceptor drum 10 with the leaser beam L, thereby forming an electrostatic latent image thereon. The development device 12 supplies toner to the electrostatic latent image formed on the photoreceptor drum 10, thus developing it into a toner image.

The toner image is then transferred by the transfer roller 4 onto the sheet P fed by the sheet feeding device 2. Specifically, a transfer electrical field is generated with a transfer bias applied from a high-pressure power source to the transfer roller 4, and the toner image is electrostatically transferred from the photoreceptor drum 10 onto the sheet P with effects of the transfer electrical field (transfer process).

After the transfer process, the cleaning device 13 removes toner remaining on the photoreceptor drum 10 (cleaning process). Additionally, the discharger removes electrical charges remaining on the photoreceptor drum 10 after the cleaning process, and the surface of the photoreceptor drum 10 is initialized as a preparation for subsequent image formation.

After the transfer process, the sheet P is conveyed to the fixing device 7 positioned downstream from the transfer roller 4 in the sheet conveyance direction. The sheet P on which the toner image is formed is guided by the entry guides 21 into the fixing nip, where the sheet P is heated and pressed by the fixing roller 15 and the pressure roller 16. Thus, the toner image is fixed on the sheet P.

Subsequently, the sheet P is guided by the discharge guides 22 to an outlet 24, through which the sheet P is discharged outside the printer body 100 by the discharge rollers 23.

Next, specific features of the present embodiment are described below with reference to FIG. 2.

Figure 2:
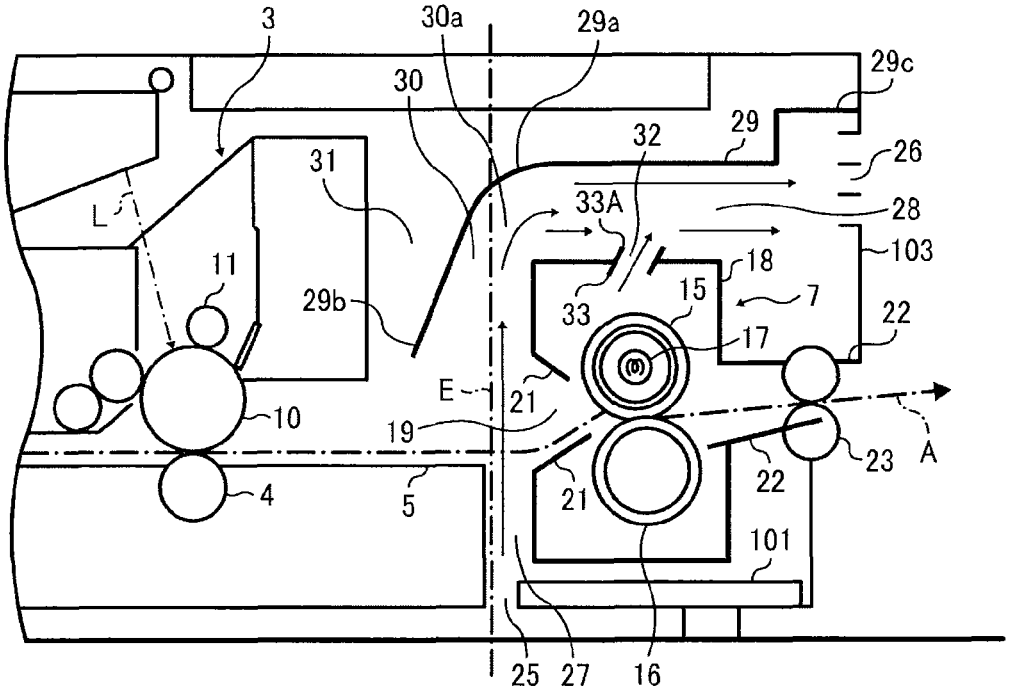
FIG. 2 is an enlarged view illustrating an exhaust structure for a fixing device according to a first embodiment.

In FIG. 2, an outer cover of the printer body 100 includes a bottom plate 101 and a front wall 103. It is to be noted that arrows shown in FIG. 2 represent airflow generated inside the image forming apparatus 1.

As shown in FIG. 2, an air intake 25 is formed in the bottom plate 101 of the printer body 100 to suck in external air, and an exhaust outlet 26 is formed in the front wall 103 (on the right in FIG. 2) to discharge air from the printer body 100.

The air intake 25 is positioned beneath the sheet inlet 19 of the fixing device 7. Above the air intake 25, an air channel 27 communicating with the air intake 25 is formed to guide the air sucked in toward the sheet inlet 19 of the fixing device 7.

The conveyance guide 5 is at a distance from the fixing device 7 in the horizontal direction not to block the air sucked in through the air intake 25 and to allow the air to pass through a clearance (i.e., air channel 27) between the conveyance guide 5 and the fixing device 7.

The exhaust outlet 26 is positioned higher than the fixing device 7. Additionally, a horizontal air channel 28 communicating with the exhaust outlet 26 is formed above the fixing device 7.

Additionally, a thermal shield 29 is provided between the fixing device 7 and the process unit 3. For example, the thermal shield 29 is a planar member including a bent portion 29*a*, an upper end 29*c* disposed above the exhaust outlet 26, and a lower end 29*b*. The bent portion 29*a* does not include a sharp corner but is curved smoothly into a crescent or arc.

The thermal shield 29 is disposed to extend at least right above the sheet inlet 19 of the fixing device 7, and an air channel 30 is formed between the fixing device 7 and the thermal shield 29. The air channel 30 extends vertically or substantially vertically and communicates with the air channel 27 on the side of the air intake 25 as well as the horizontal channel 28 on the side of the exhaust outlet 26. More specifically, the air channel 30 communicates with the horizontal channel 28 via a bent portion 30*a* that is in conformity with the bent portion 29*a* of the thermal shield 29.

The horizontal channel 28 and the air channel 30 are formed between the thermal shield 29 and the fixing cover 18.

Additionally, a clearance 31 is provided between the thermal shield 29 and the process unit 3 to inhibit heat transmission from the thermal shield 29 to the process unit 3.

Arrangement of the fixing device 7, the process unit 3, the air intake 25, the exhaust outlet 26, and the thermal shield 29 are described in further detail below.

In FIG. 2, dashed vertical lines E represent a virtual plane that extends vertically passing through the air intake 25. The virtual plane E is perpendicular to the sheet conveyance path A that is horizontal or substantially horizontal, and the virtual plane E parallels the width direction of the sheet P (hereinafter "sheet width direction"). The sheet width direction is perpendicular to the surface of the paper on which FIG. 2 is drawn. The fixing device 7 and the process unit 3 are positioned on the opposite sides across the virtual plane E. In other words, in the sheet conveyance direction, the process unit 3 is positioned upstream from the virtual plane E, and the fixing device 7 is positioned downstream from the virtual plane E.

The exhaust outlet 26 is on the same side as the fixing device 7, that is, downstream from the virtual plane E in the sheet conveyance direction.

The upper end 29*c* of the thermal shield 29, disposed above the exhaust outlet 26, and the lower end 29*b* are on the opposite sides across the virtual plane E. In other words, the upper end 29*c* is downstream from the virtual plane E, and the lower end 29*b* is upstream from the virtual plane E in the sheet conveyance direction.

The bent portion 29*a* of the thermal shield 29 is positioned above the sheet inlet 19 of the fixing device 7. An opening 32 communicating with an interior of the fixing device 7 is formed in a portion of the fixing cover 18 defining the horizontal channel 28.

In the fixing device 7, the fixing roller 15 is kept hot, for example, in a range of from about 155° C. to about 165° C. It is not desirable that the heat of the fixing roller 15 raises temperature inside the apparatus, in particular, temperature of the process unit 3 or the exposure unit 6 adjacent to the fixing device 7.

Air heated by the fixing roller 15 flows upward from the fixing device 7, and the ascending stream of hot air causes a negative pressure around the fixing device 7. Accordingly, external air is sucked in through the air intake 25 on the bottom of the image forming apparatus 1. The air sucked in through the air intake 25 flows through the air channel 27 between the conveyance guide 5 and the fixing device 7, and is guided to the sheet inlet 19 of the fixing device 7.

With the external air sucked in the apparatus, the hot air released from the sheet inlet 19 flows through the air channel 30 and the horizontal air channel 28 formed between the thermal shield 29 and the fixing device 7, and is discharged from the exhaust outlet 26 outside the apparatus. Specifically, the hot air released from the sheet inlet 19 of the fixing device 7 ascends, contacts the thermal shield 29, and then is guided along the thermal shield 29 to the upper end 29*c*. At that time, the bent portion 29*a* of the thermal shield 29 changes the direction of the hot air into the horizontal direction toward the exhaust outlet 26.

As described above, external air can be sucked inside the apparatus through the air intake 25 due to the negative pressure caused by the ascending stream of hot air heated by the fixing device 7. Accordingly, without exhaust fans or cooling fans, air can flow smoothly in the air channel, and the hot air released from the sheet inlet 19 of the fixing device 7 can be discharged from the exhaust outlet 26.

Additionally, the fixing device 7 is disposed on the opposite side from the lower end 29*b* of the thermal shield 29 across the virtual plane E so that the hot air released from the sheet inlet 19 does not flow in other directions than the intended direction.

With this arrangement, the hot air released from the sheet inlet 19 can be prevented or inhibited from moving toward the process unit 3 or the exposure unit 6, and temperature rise of the process unit 3 or the exposure unit 6 can be restricted effectively.

Additionally, when the direction of the ascending hot air is changed to the horizontal direction in the bent portion 29*a* of the thermal shield 29, the hot air is not retained but can be guided smoothly to the exhaust outlet 26 because the bent portion 29*a* does not have a sharp corner but is curved.

Even if the thermal shield 29 is heated by the hot air, the clearance (air layer) 31 provided between the thermal shield 29 and the process unit 3 can inhibit transmission of heat from the thermal shield 29 to the process unit 3. Accordingly, temperature rise of the process unit 3 or the like can be restricted effectively.

Further, stream of hot air released from the opening 32 formed in the fixing cover 18 can accelerate the airflow inside the horizontal air channel 28. This configuration can further facilitate the airflow inside the air channel toward the exhaust outlet 26, and the hot air released from the sheet inlet 19 of the fixing device 7 can be efficiently discharged from the exhaust outlet 26.

Additionally, in the configuration shown in FIG. 2, the fixing cover 18 includes a guide 33 provided to a rim defining the opening 32 to guide the airflow released from the opening 32 toward the exhaust outlet 26.

The guide 33 provided at the opening 32 is inclined relative to the horizontal air channel 28 so that the air released from the opening 32 can obliquely merge into the airflow in the horizontal air channel 28, thereby accelerating the velocity of airflow. Specifically, the guide 33 obliquely ascends downstream in the direction of airflow in the horizontal air channel 28. In other words, an upper end 33A of the guide 33 is positioned downstream from the other end of the guide 33.

In particular, in the configuration show in FIG. 2, the opening 32 is positioned in the upper face of the fixing device 7. Further, the opening 32 communicates with the horizontal air channel 28, that is, positioned inside the horizontal air channel 28. This arrangement can accelerate the velocity of airflow inside the horizontal air channel 28, which tends to be slowed by natural convection. Accordingly, the airflow inside the air channel can be facilitated further, and the hot air released from the sheet inlet 19 of the fixing device 7 can be efficiently discharged from the exhaust outlet 26.

Specifically, although heat generated by the heater 17 can accumulate inside the fixing device 7, the opening 32 can generate the ascending stream of air flowing out therethrough and accelerate the velocity of air flowing in the horizontal air channel 28.

Figure 3:
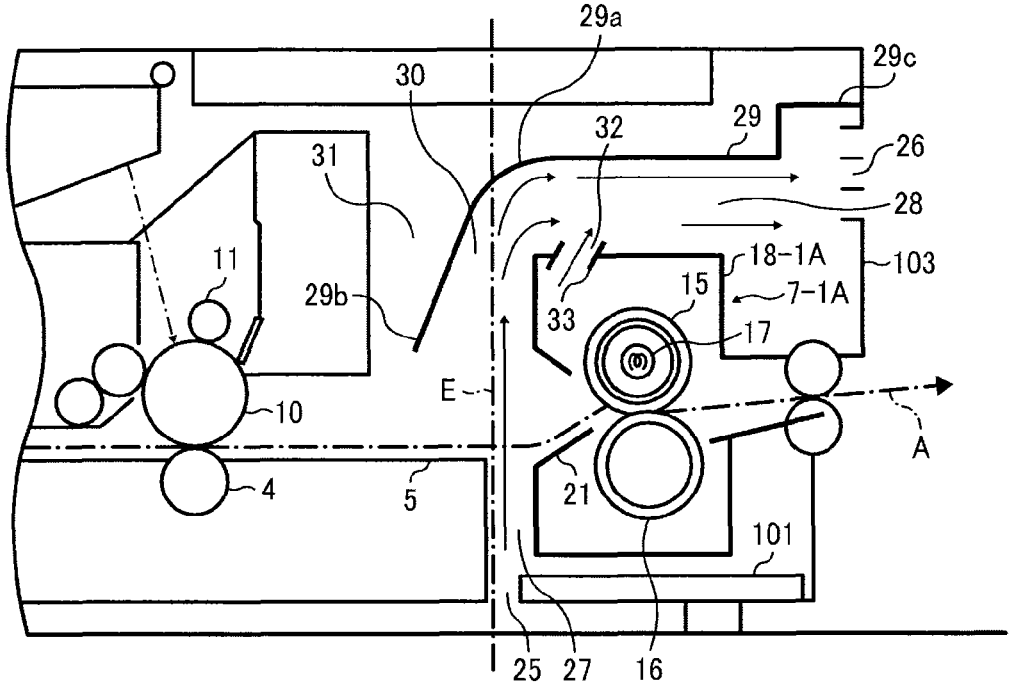
FIG. 3 illustrates a variation of the configuration shown in FIG. 2.

FIG. 3 illustrates a variation of the configuration shown in FIG. 2.

In the configuration shown in FIG. 3, a fixing device 7-1A includes a fixing cover 18-1A in which the position of the opening 32 is different from that in the configuration shown in FIG. 2. Specifically, the opening 32 in FIG. 3 is adjacent to the bent portion 29*a*, and this arrangement can attain the following advantage.

The airflow direction in the air channel 30 is changed to the horizontal direction in the bent portion 29*a*, which means that velocity of airflow starts to slow in the bent portion 29*a*, causing loss in energy in the bent portion 29*a*. Therefore, accelerating the airflow at the curving portion, that is, an extreme upstream position in the portion where the velocity of airflow starts to decrease, is effective in inhibiting decreases in the velocity of airflow. Accordingly, the airflow inside the air channel can be facilitated further, and the hot air released from the fixing device 7 can be efficiently discharged outside.

With the above-described aspects of the present embodiment, hot air can be discharged efficiently even in configurations in which a part of the air channel is horizontal. This configuration can secure flexibility in layout of the exhaust channel and design flexibility of the apparatus while fully exploiting advantages in natural convection exhausting methods.

Figure 4:
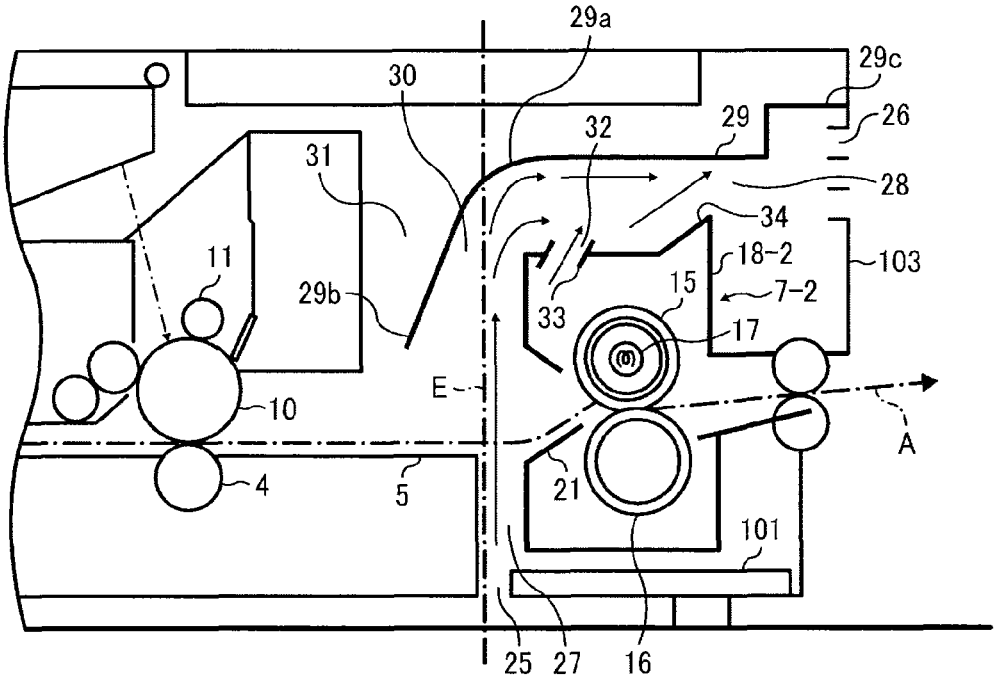
FIG. 4 illustrates an exhaust structure according to a second embodiment.

FIG. 4 illustrates an exhaust structure according to a second embodiment.

It is to be noted that components similar to those of the above-described embodiment are given identical or similar reference characters, and thus descriptions thereof are omitted in the second and subsequent embodiments.

Although, in the above-described first embodiment, the configuration around the opening 32 is designed to accelerate the airflow in the air channel, thereby facilitating hot air exhaustion, it is possible that the hot air heats the exhaust outlet 26, raising temperature of the front wall (outer cover) 103 of the apparatus.

Specifically, in the configuration shown in FIGS. 2 and 3, it is possible that the hot air is retained inside a compartment that is somewhat closed, enclosed by the fixing cover 18 and the outer cover 103 and positioned lower than the exhaust outlet 26. It causes the temperature rise of the outer cover 103.

In view of the foregoing, in the present embodiment, a fixing cover 18-2, which is a casing of a fixing device 7-2, includes an inclined surface 34 ascending toward the exhaust outlet 26, that is, ascending downstream in the airflow direction in the air channel. The inclined surface 34 is in the downstream portion of the fixing cover 18-2 in the direction of airflow in the horizontal air channel 28.

Being guided by the inclined surface 34, the hot air inside the horizontal air channel 28 flows upward and contacts the thermal shield 29. Then, the hot air flows along the thermal shield 29 and is discharged outside through the exhaust outlet 26.

Guiding the air flowing in the horizontal air channel 28 to contact the thermal shield 29 can extend the route of the airflow, and the air can be cooled better in the horizontal air channel 28. Thus, the temperature rise of the outer cover 103 can be inhibited.

Additionally, in this configuration, the hot air is not retained in the compartment beneath the exhaust outlet 26 but can be guided smoothly to the exhaust outlet 26.

Figure 5:
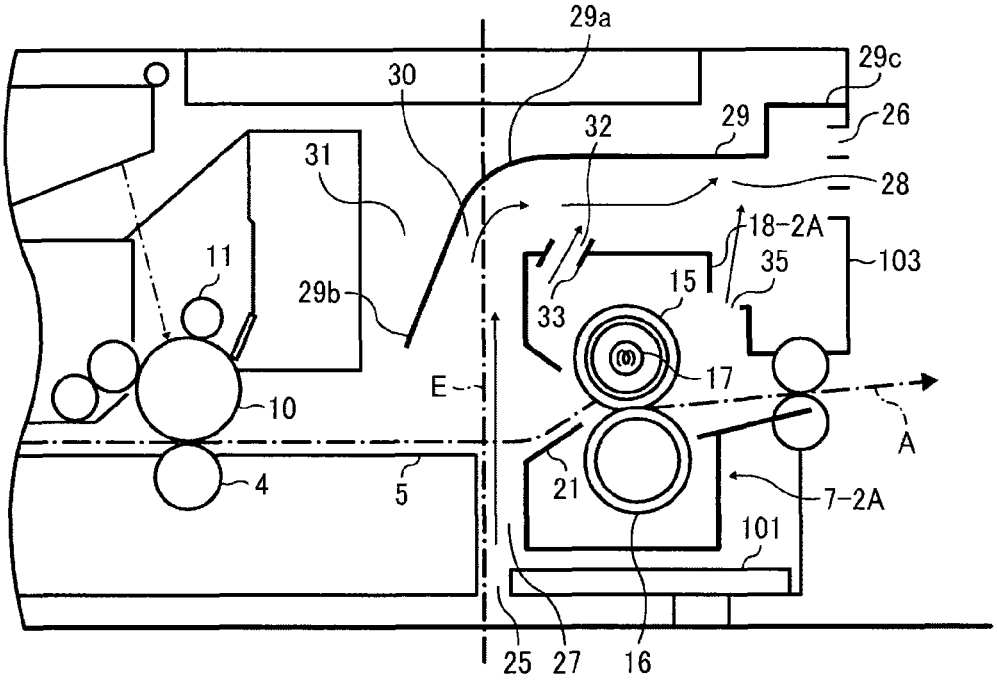
FIG. 5 illustrates a variation of the configuration shown in FIG. 4.

FIG. 5 illustrates a variation of the configuration shown in FIG. 4.

A fixing cover 18-2A of a fixing device 7-2A shown in FIG. 5 is characterized in that, instead of the inclined surface 34, another opening 35 is provided beneath the horizontal air channel 28. It is to be noted that hereinafter the openings 32 and 35 are also referred to as first and second openings 32 and 35. The second opening 35 is disposed between the first opening 32 and the exhaust outlet 26 and under the thermal shield 29.

With the hot air flowing out through the second opening 35, the hot air inside the horizontal air channel 28 flows upward and contacts the thermal shield 29. Then, the hot air flows along the thermal shield 29 and is discharged outside through the exhaust outlet 26.

Guiding the air flowing in the horizontal air channel 28 to contact the thermal shield 29 can extend the route of the airflow, and the air can be cooled better in the horizontal air channel 28. Further, the hot air flowing inside the horizontal air channel 28 does not go straight to the exhaust outlet 26. Accordingly, the temperature rise of the outer cover 103 can be inhibited.

Figure 6:
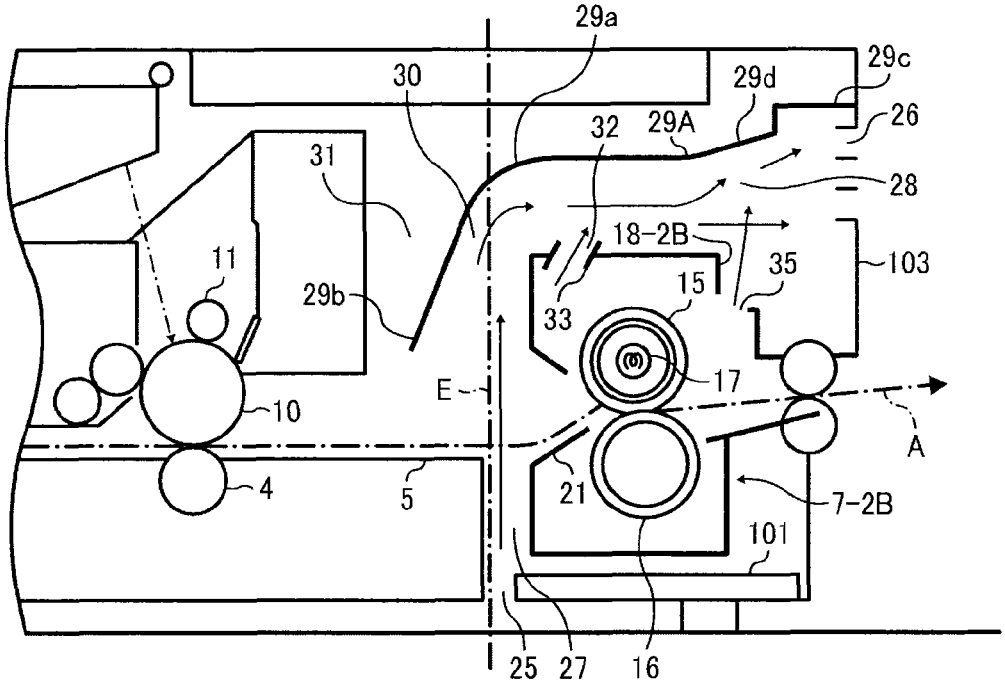
FIG. 6 illustrates another variation of the configuration shown in FIG. 4.

FIG. 6 illustrates another variation of the configuration shown in FIG. 4.

A fixing cover 18-2B of a development device 7-2B shown in FIG. 6 includes a second opening 35 similarly to the configuration shown in FIG. 5.

The variation shown in FIG. 6 is characterized in that a thermal shield 29A includes an inclined face 29*d* that is positioned above the second opening 35 and ascends toward the exhaust outlet 26, that is, ascends downstream in the airflow direction in the air channel. With this configuration, the air released from the second opening 35 can be guided upward to the exhaust outlet 26. Further, while restricting decreases in the velocity of the airflow in the horizontal air channel 28, the airflow is directed up to contact the thermal shield 29A and then is guided to the exhaust outlet 26 along the thermal shield 29A.

Thus, effects similar to those attained by the configurations shown in FIGS. 4 and 5 can be attained.

Figure 7:
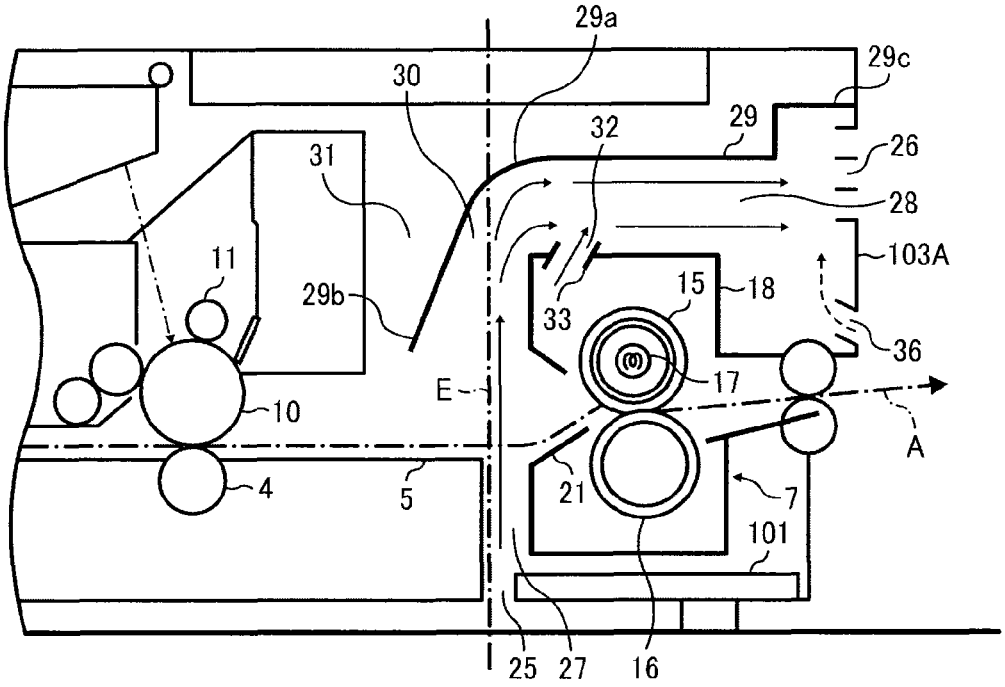
FIG. 7 illustrates an exhaust structure according to a third embodiment.

FIG. 7 illustrates an exhaust structure according to a third embodiment.

The configuration shown in FIG. 7 is similar to those shown in FIGS. 2 and 3 except that an outer cover 103A is different from the outer cover 103 shown in FIGS. 2 through 6. Specifically, an opening 36 serving as a ventilation portion communicating with the interior of the printer body 100 is formed in the outer cover 103A in which the exhaust outlet 26 is formed. The opening 36 is positioned beneath the exhaust outlet 26.

Providing the opening 36 can generate airflow for sucking external air in the printer body 100 as indicated by broken arrow shown in FIG. 7. The external air thus sucked in can cool the interior of the outer cover 103A, thus restricting the temperature rise of the outer cover 103A.

Figure 8:
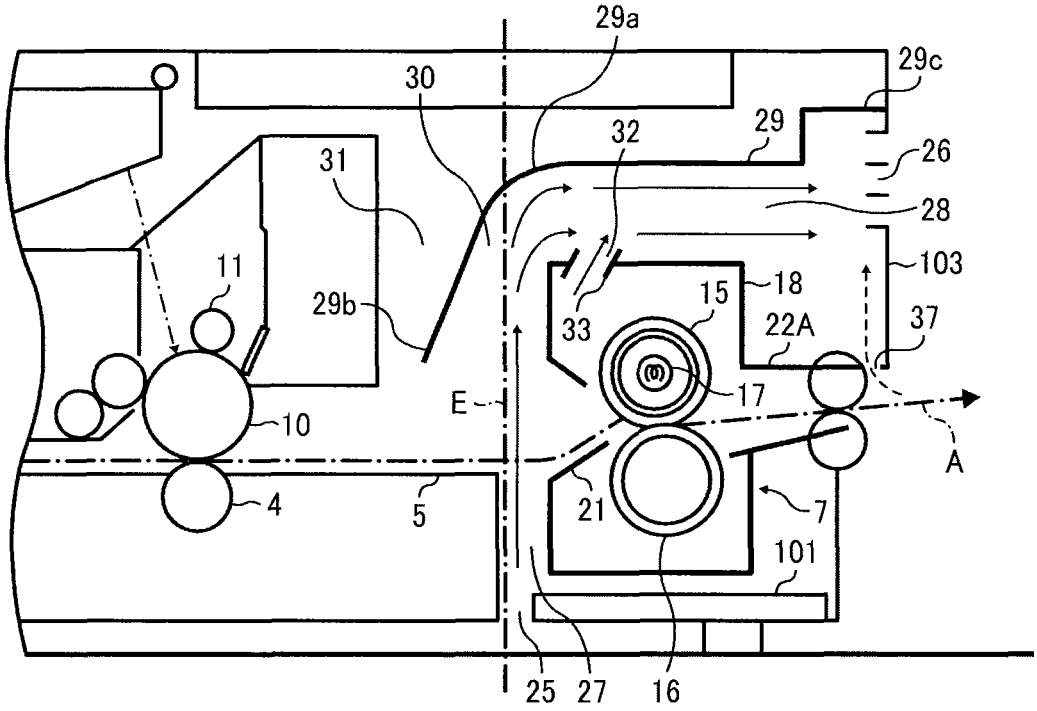
FIG. 8 illustrates a variation of the configuration shown in FIG. 7.

FIG. 8 illustrates a variation of the configuration shown in FIG. 7.

In the variation shown in FIG. 8, a pair of discharge guides 22A is different from the discharge guides 22 shown in any of FIGS. 2 through 7. Specifically, an opening 37 is formed in the upper counterpart of the pair of discharge guides 22A defining the outlet 20 of the fixing device 7. The opening 37 connects the interior of the printer body 100 and the outside.

The opening 37 can be formed at a position that is not visible from the front side (on the right in FIG. 8) of the image forming apparatus 1 not to degrade the appearance. Providing the opening 37 can generate airflow for sucking in external air as indicated by broken arrow shown in FIG. 8. The external air thus sucked in can cool the interior of the outer cover 103, thus restricting the temperature rise of the outer cover 103. Additionally, the hot air can be prevented from being retained in the compartment defined by the fixing cover 18 and the outer cover 103 and positioned lower than the exhaust outlet 26.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an outer cover;

an air intake in a bottom facing surface of the image forming apparatus, the bottom facing surface being perpendicular to side surfaces of the outer cover;

an image forming unit to form an image on a recording medium;

a fixing device to fix the image on the recording medium, the fixing device including a fixing casing in which a sheet inlet through which the recording medium enters the fixing device and a first exhaust opening to discharge hot air from the fixing device are formed; and a thermal shield disposed above the sheet inlet of the fixing device and between the fixing device and a component adjacent to the fixing device, the thermal shield forming an air channel together with the fixing casing to guide air entering the air intake to an exhaust outlet, wherein the first exhaust opening of the fixing casing communicates with the air channel formed by the thermal shield and the fixing casing to merge the hot air discharged from the fixing device into the air flowing in the air channel, and wherein the air channel comprises a vertical channel extending substantially vertically from the air intake and a horizontal channel extending substantially horizontally, and the first exhaust opening of the fixing casing communicates with the horizontal channel.

2. The image forming apparatus according to claim 1, wherein the air channel further comprises a bent portion positioned between the vertical channel and the horizontal channel, the horizontal channel includes a first end communicating with the exhaust outlet of the outer cover of the image forming apparatus and a second end communicating with the vertical channel via the bent portion, and the first exhaust opening of the fixing casing is adjacent to the bent portion of the air channel.

3. The image forming apparatus according to claim 1, wherein the fixing casing comprises an inclined surface on the side of the air channel, and the inclined surface ascends downstream in a direction in which the air flows in the horizontal channel.

4. The image forming apparatus according to claim 1, wherein a second exhaust opening is formed in the fixing casing on the side of the air channel, the second exhaust opening disposed between the first exhaust opening and the exhaust outlet of the outer cover of the image forming apparatus.

5. The image forming apparatus according to claim 4, wherein the thermal shield comprises an inclined face above the second exhaust opening of the fixing casing, and the inclined face of the thermal shield ascends downstream a direction in which the air flows in the air channel to guide the air upward.

6. The image forming apparatus according to claim 1, further comprising an ventilation portion disposed beneath the exhaust outlet of the outer cover, and the ventilation portion connects the air channel to the outside of the image forming apparatus.

7. The image forming apparatus according to claim 6, wherein the fixing device further comprises a discharge guide provided to a sheet outlet of the fixing casing to guide a sheet discharged from the fixing device, and the ventilation portion is formed in the discharge guide.

8. The image forming apparatus according to claim 1, wherein the first exhaust opening discharges an ascending stream of hot air from the fixing device, and wherein the first exhaust opening of the fixing casing communicates with the air channel formed by the thermal shield and the fixing casing to merge the ascending stream of hot air discharged from the fixing device into a natural convection of the air flowing in the air channel.

9. An image forming apparatus according to claim 8, wherein a velocity of the natural convection of the air merged with the ascending stream of hot air accelerates according to the ascending stream of hot air.

10. An image forming apparatus, comprising:

an outer cover including an exhaust outlet;

an air intake in a bottom facing surface of the image forming apparatus, the bottom facing surface being perpendicular to side surfaces of the outer cover;

an image forming unit to form an image on a recording medium;

a fixing device to fix the image on the recording medium, the fixing device including a fixing casing in which a sheet inlet through which the recording medium enters the fixing device and a first exhaust opening to discharge an ascending stream of hot air from the fixing device; and a thermal shield disposed above the sheet inlet of the fixing device and an upper surface of the fixing casing, the thermal shield forming an air channel together with the fixing casing to guide air entering the air intake to the exhaust outlet, the air channel receiving air from the air intake, wherein the first exhaust opening of the fixing casing communicates with the air channel formed by the thermal shield and the fixing casing to merge the ascending stream of hot air discharged from the fixing device into a natural convection of the air flowing in the air channel.

11. An image forming apparatus according to claim 10, wherein a velocity of the natural convection of the air merged the ascending stream of hot air accelerates according to the ascending stream of hot air.

12. An image forming apparatus according to claim 10, wherein the air intake forms a bottom of the image forming apparatus.

13. An image forming apparatus according to claim 10, wherein the air intake is arranged below the sheet inlet of the fixing casing.

14. The image forming apparatus according to claim 10, wherein the air channel further comprises a bent portion positioned between the vertical channel and a horizontal channel, the horizontal channel includes a first end communicating with the exhaust outlet of the outer cover of the image forming apparatus and a second end communicating with the vertical channel via the bent portion, and the first exhaust opening of the fixing casing is adjacent to the bent portion of the air channel.

15. An image forming apparatus, comprising:

an outer cover including an exhaust outlet;

an air intake;

an image forming unit to form an image on a recording medium;

a fixing device to fix the image on the recording medium, the fixing device including a fixing casing in which a sheet inlet through which the recording medium enters the fixing device and a first exhaust opening to discharge hot air from the fixing device; and a thermal shield disposed above the sheet inlet of the fixing device and between the fixing device and a component adjacent to the fixing device, the thermal shield forming an air channel together with the fixing casing to guide air entering the air intake to the exhaust outlet, wherein the first exhaust opening of the fixing casing communicates with the air channel formed by the thermal shield and the fixing casing to merge the hot air discharged from the fixing device into the air flowing in the air channel, wherein the fixing device operates without an airflow fan to cool the fixing device.

16. The image forming apparatus according to claim 15, wherein:

the air intake is formed in a bottom portion of the image forming apparatus, the air channel comprises a vertical channel extending substantially vertically from the air intake, and a horizontal channel extending substantially horizontally and the first exhaust opening of the fixing casing communicate with the horizontal channel.

17. An image forming apparatus according to claim 16, wherein the air intake forms a bottom of the image forming apparatus.

* * * * *